US005960529A

United States Patent [19]

Haesemann et al.

[11] Patent Number: 5,960,529

[45] Date of Patent: Oct. 5, 1999

[54] APPARATUS AND METHOD FOR DEFORMING A JACKET TUBE OF A HONEYCOMB BODY

[75] Inventors: Gottfried W. Haesemann, Kürten; Lutz Guthke, Siegburg; Ludwig Wieres, Overath, all of Germany

[73] Assignee: Emitec Gessellschaft fuer Emissionstechnologie mbH, Lohmar, Germany

[21] Appl. No.: 08/852,538

[22] Filed: May 7, 1997

Related U.S. Application Data

[63] Continuation of application No. PCT/EP95/04007, Oct. 11, 1995.

[30] Foreign Application Priority Data

Nov. 19, 1994 [DE] Germany ..... 44 39 685

[51] Int. Cl.[6] ..... B21D 39/00

[52] U.S. Cl. ..... 29/516; 29/520; 29/890; 29/796; 29/283.5; 72/402

[58] Field of Search ..... 29/890, 516, 796, 29/783, 788, 283.5, 520; 72/402

[56] References Cited

U.S. PATENT DOCUMENTS

| | | | |
|---|---|---|---|
| 1,591,067 | 7/1926 | Wiley | 29/520 |
| 1,984,115 | 12/1934 | Cooper | 29/520 |
| 2,026,774 | 1/1936 | Davis et al. | 29/520 |
| 2,362,008 | 11/1944 | Hile | 29/520 |
| 2,536,821 | 1/1951 | Rappl | 29/520 |
| 2,998,049 | 8/1961 | Winslow | 29/235 |
| 3,085,316 | 4/1963 | Nelson | 29/517 |
| 3,281,933 | 11/1966 | Fehling et al. | 29/520 |
| 3,879,834 | 4/1975 | Johnson | 29/516 |
| 3,977,065 | 8/1976 | Johnson | 29/516 |
| 4,413,392 | 11/1983 | Otani et al. | 29/520 |
| 4,519,120 | 5/1985 | Nonnenmann et al. | 29/455.1 |
| 4,691,550 | 9/1987 | Dietzel | 29/516 |
| 5,096,111 | 3/1992 | Ishikawa et al. . | |
| 5,724,735 | 3/1998 | Ickes et al. | 29/890 |
| 5,755,025 | 5/1998 | Wirth et al. | 29/520 |

FOREIGN PATENT DOCUMENTS

| | | |
|---|---|---|
| 0 117 602 B1 | 9/1984 | European Pat. Off. . |
| 28 56 030 C2 | 6/1980 | Germany . |
| 87 01 980 | 6/1987 | Germany . |
| 2 020 190 | 11/1979 | United Kingdom . |
| 2 270 869 | 3/1994 | United Kingdom . |

*Primary Examiner*—David P. Bryant
*Attorney, Agent, or Firm*—Herbert L. Lerner; Laurence A. Greenberg

[57] ABSTRACT

An apparatus for deforming a jacket tube of a honeycomb body includes a plurality of radially displaceable segments each having a sliding surface with a wedge-shaped cross section. At least one annular, axially displaceable closing element surrounds the segments and has at least one oblique surface sliding on the sliding surface. An actuating device connected to the closing element has an annular shape defining an opening through which the honeycomb body with the jacket tube can enter from one side and exit from the other side. A method for deforming a jacket tube on a honeycomb body includes passing the honeycomb body with the jacket tube through at least one tunnel-like calibrating station in which the jacket tube is deformed. A transport direction of the honeycomb body and the jacket tube during a production process is maintained during the deformation.

26 Claims, 4 Drawing Sheets

APPARATUS AND METHOD FOR DEFORMING A JACKET TUBE OF A HONEYCOMB BODY

CROSS-REFERENCE TO RELATED APPLICATION

This application is a Continuation of International Application Serial No. PCT/EP95/04007, filed Oct. 11, 1995.

BACKGROUND OF THE INVENTION

Field of the Invention

The invention relates to an apparatus and a method for deforming a jacket tube of a honeycomb body, particularly for cleaning internal combustion engine exhaust gases.

Apparatuses for cleaning exhaust gas are known to have a metal catalyst carrier body. The metal catalyst carrier body is produced by winding or intertwining sheet-metal layers, at least some of which are structured. Such catalyst carrier bodies are described, for example, in European Patent Application 0 245 738, corresponding to U.S. Pat. Nos. 4,803,189 and 4,946,822.

The catalyst carrier bodies are disposed in a jacket tube or housing. The individual sheet-metal layers are joined to one another and to the jacket tube, for instance by brazing, sintering or welding.

The apparatus is integrated into an exhaust system. Since both ends of the apparatus must each be connected to one tube of the exhaust system, the apparatus is connected with a diffusor on the exhaust inlet side and with a reducing piece on the exhaust outlet side. The purpose of the diffusor is to enlarge the flow cross section for the exhaust gas from the cross section of the tube to the cross section of the apparatus, and the purpose of the reducing piece is to reduce the flow cross section on the outlet side of the apparatus to the cross section of the tube which then follows. The joining of the diffusor and of the reducing piece to the apparatus is carried out by welding. That requires that the dimensions of the tube on the inlet and outlet sides of the exhaust gas and the contour of the jacket tube be within certain tolerance limits. Typically, the jacket tube protrudes from 5 to 10 mm beyond both end surfaces of the catalyst carrier body. In order to attain the geometry and dimensions of the jacket tube required for connection to the diffusor and to the reducing piece, the jacket tube is calibrated from the inside before and/or after the insertion of the catalyst carrier body. The calibration has heretofore generally been performed in such a way that a tool which has a plurality of segments is introduced into the jacket tube, and the individual segments are radially spread outward. The spreading of the segments is carried out from the flow limit of the jacket tube material outward, so that in that region the jacket tube is free of stress. Since the segments of the tool are spread radially outward, it is not possible to achieve an exactly predetermined contour.

U.S. Pat. No. 5,096,111 discloses an apparatus for producing a honeycomb body with a jacket tube that includes a plurality of radially displaceable segments, by which the jacket tube of the honeycomb body can be performed. The individual segments are joined by one end to a carrier, which is connected to a piston rod of a cylinder-piston unit. The carrier having the segments is displaceable axially within a cylindrical body and out of it. To that end, the cylinder-piston unit is joined to the cylindrical body. In the inlet region of the cylindrical body, a conical segment is formed, which tapers from the inlet side in the axial direction. In order to deform the jacket tube, a number of segments fit around the jacket tube of the honeycomb body. Next, the honeycomb body is pulled into the cylindrical body through the use of the cylinder-piston unit. The honeycomb body is successively deformed in the conical segment in the course of being pulled in. Once the deformation has been done, the honeycomb body with the segments is pulled out of the cylindrical body by the cylinder-piston unit. During the axial displacement of the segments, the segments slide along the inner jacket surface of the cylindrical body.

Published UK Patent Application GB 2 020 190 A discloses the use of an apparatus that has a plurality of radially movable segments to deform the jacket tube of a honeycomb body. Exhaust gas cleaning apparatuses are also known in which the catalyst carrier body is formed of a ceramic material. Such catalyst carrier bodies are disposed in a two-piece housing. German Utility Model G 87 01 980.9 U1 describes such a housing for receiving a monolithic ceramic body.

Half-shells of the housing are made from one metal sheet by deep drawing. In order to support the ceramic catalyst carrier body, a sheath for the ceramic body is provided between the outside of the carrier body and the housing.

The two housing shells are then pressed together and welded in gas-tight fashion at their contacting surfaces. Corresponding production methods for an apparatus for exhaust gas cleaning with metal catalyst carrier bodies are known from German Patent DE 28 56 030 C2 and European Patent Application 0 117 602 B1, corresponding to U.S. Pat. No. 4,559,205.

The housing parts can be produced with high accuracy. However, it is not possible to produce the ceramic catalyst carrier bodies exactly enough. It is therefore necessary to dimension the housing in such a way that even oversized ceramic catalyst carrier bodies or ceramic catalyst carrier bodies with slight deformations can be integrated into the housing. In order to prevent a gap, through which the exhaust gas flows uncleaned, from forming between the catalyst carrier body and the housing, an intermediate layer is placed there, especially a so-called swelling mat. Other intermediate layers, with wire mesh and the like, are also known. Those layers may also be coated with a catalyst.

It is therefore relatively expensive to produce an apparatus for exhaust gas cleaning that has a ceramic catalyst carrier body.

SUMMARY OF THE INVENTION

It is accordingly an object of the invention to provide an apparatus and a method for deforming a jacket tube of a honeycomb body, which overcome the hereinafore-mentioned disadvantages of the heretofore-known devices and methods of this general type, in which the apparatus is structurally simple and rationally brings about uniform, gentle deformation of the jacket tube and in which the method simplifies the production of a honeycomb body and allows higher cycle times in the production of the honeycomb body.

With the foregoing and other objects in view there is provided, in accordance with the invention, an apparatus for deforming a jacket tube of a honeycomb body, comprising a plurality of radially displaceable segments each having a sliding surface with a wedge-shaped cross section; at least one annular, axially displaceable closing element surrounding the segments and having at least one oblique surface sliding on the sliding surface; and an actuating device connected to the closing element, the actuating device having an annular shape defining an opening with two sides through which a honeycomb body with a jacket tube can enter from one side and from which the honeycomb body with the jacket tube can exit from the other side.

The apparatus according to the invention for deforming a honeycomb body with a jacket tube, is distinguished in that the segments each have a sliding surface of wedge-shaped cross section. The segments are surrounded by an axially displaceable annular closing element, which has at least one oblique surface. Upon an axial displacement of the closing element, the oblique surface of the closing element slides on the wedge-shaped sliding surface of each segment, and as a result the axial displacement of the ring causes a radial displacement of the segments toward the jacket tube. The simultaneous radial motion of the segments means that all the segments exert a force on the jacket tube synchronously, and due to this force the jacket tube is plastically deformed. An actuating device is provided that is connected to the closing element for the axial displacement of the closing element. The force transmitted to the segments from the closing element can be adjusted accordingly through the use of the angle of the inclined surfaces.

The inclination of the sliding surface of each segment and the oblique surface of the closing element that engages the sliding surface need not be the same for each segment. Depending on the region in which the apparatus is used and the deformation generated by the apparatus, the inclined surfaces can be constructed differently, and as a result different forces can act upon the jacket tube in the circumferential direction.

As a result, a uniform strain on the honeycomb body is attainable. This is especially valuable in honeycomb bodies of ceramic materials or in extruded metal honeycomb bodies, since as a result a uniform compressive strain can be established without the creation of tensile forces or shear forces that will destroy the body.

In accordance with another feature of the invention, the plurality of segments are at least four and preferably six, eight or twelve segments.

In accordance with a further feature of the invention, the segments can deform the jacket tube directly. In that case the segments act at the same time as tool segments.

According to a further advantageous concept, it is proposed that inner tool segments be detachably connected to segments, for instance by being suspended in them. This further feature provides a broader range of uses of the apparatus. By simply replacing the inner tool segments, different cross sections of a jacket tube can be brought about by plastic deformation. The number of tool segments need not necessarily match the number of segments. However, in accordance with an added feature of the invention, the number of tool segments does match the number of segments.

In accordance with an additional feature of the invention, the oblique surface of the closing element is only partially in contact with the sliding surface, so that the two surfaces form a free angle with one another. This angle preferably ranges from 0.5 to 3°. This assures that jamming of the closing element and the segments will not ensue.

In accordance with yet another feature of the invention, the segments are radially inwardly displaceable counter to a spring force. This has the advantage that once plastic deformation of the jacket tube has taken place and the closing element has been displaced axially into a position in which the sliding surface and the oblique surface are no longer in contact with one another, the segments will automatically move radially outward, thus releasing the honeycomb body.

In accordance with yet a further feature of the invention, there is provided at least one spring element, which is connected to each segment.

In accordance with yet an added feature of the invention, the spring element is a spring ring, which is disposed in a groove formed on the surface of each sector opposite the sliding surface.

The spring element is then compressively strained. If the segments are at the same time tool parts that directly deform the jacket tube, then it is expedient to cover the grooves or to place the spring element on the outer surface of the segments, and as a result over the axial length of the segments there will be no irregularities in the surface of the segment that comes to rest on the jacket tube.

The actuating device for actuating the closing element includes at least two and preferably four rods, one plate, and one cylinder-piston unit. The piston rod of the cylinder-piston unit is joined to the plate. One end of each rod is joined to the plate, and the other end of each rod is joined to the closing element. The cylinder-piston unit transmits the axial motion to the closing element through the plate and the rods. This embodiment has the advantage of only requiring one cylinder-piston unit for generating force.

Suitably, the plate is slidingly guided, which prevents any possible crooked position of the closing element.

The segments are preferably disposed on a base plate. A bottom plate is provided below the base plate. Carriers are disposed between the base plate and the bottom plate, and the base plate, the bottom plate and the carriers form a frame of the apparatus. The cylinder-piston unit is disposed on the bottom plate. The rods that engage the closing element extend through bores formed in the base plate. These through bores can at the same time act as guides for the rods. Optionally, the carriers form guides for the plate. The carriers then have a dual function, and it is possible to dispense with additional guides for the plate.

A bore is advantageously provided in the base plate, coaxially with the receptacle for the honeycomb body, which is formed by the segments. A RAM of an ejector device can be introduced into and removed from a space defined by the segments through this bore. This has the advantage of permitting the honeycomb bodies to be removed from the apparatus in a simple way. The ejector device is preferably a pneumatically or hydraulically actuatable cylinder-piston unit.

The ejector device may also be a lever that is pivotable about an axis, with its first arm being coupled to a rod or the plate and its second arm being joined to the RAM.

In accordance with yet an additional feature of the invention, there is provided a frame in which an annular chamber is formed. A piston which is connected to rods that engage the closing element is disposed in the annular chamber. The chamber can be acted upon by a fluid, which is furnished through incoming lines from a pressure reservoir, and as a result the relative location of the piston can be varied. The advantage of this construction is considered to be that the flow of force is especially favorable. The segments are then disposed on the frame, so that the frame is subjected to pressure by the axial component of the incident force. A further advantage is the integration of the actuating device with the frame, making for a markedly compact structure.

In accordance with again another feature of the invention, a stop is provided to define an axial position of a honeycomb body. In accordance with again a further feature of the invention, the stop is in the form of lugs, which are provided on at least two segments.

In accordance with again a further feature of the invention, the actuating device and the opening are disposed below the segments, the segments form a contour in a radial plane, and the outlet opening has a cross section substantially equivalent to the contour.

As a result of the apparatus according to the invention it is now possible for at least one region, preferably an end region, of the jacket tube to be deformed plastically on all sides from the outside inward by radially displaceable segments to form an outer contour of predetermined dimensions. As a result of this kind of procedure the production of the honeycomb body is simpler, since now the segments that bring about the plastic deformation do not engage the remaining narrow projection of the jacket tube from the inside but rather act from the outside on a larger end region. The aforementioned projection or excess of the jacket tube upstream and/or downstream of the catalyst carrier body can be reduced to a minimum. The projection or excess can then be dimensioned in such a way that only the respective surface area necessary for a welded connection of the jacket tube to a diffusor or a reducing piece is then made available. All of the operations and apparatuses described herein are equally applicable to round, elliptical, oval or other cross-sectional shapes, although the main application at present is to round cross-sectional shapes.

If the honeycomb body is plastically deformed on only one end region of the jacket tube, then in order to provide for the plastic deformation of the end region of the segment it is necessary to provide a second apparatus for carrying out the method or else to rotate the jacket tube 180° about its transverse axis. Neither version always provides satisfactory results. It is therefore proposed that the plastic deformation be performed by segments that engage both end regions of the jacket tube.

The entire jacket tube can be plastically deformed by the segments. The jacket tube at first has a geometry that leads to the desired geometry of the apparatus after a plastic deformation. It is not necessary that the catalyst carrier body already be firmly joined to the jacket tube prior to the deformation. In accordance with this concept of the invention, ceramic bodies which are round, elliptical or oval (racetrack-shaped) in cross-section can be secured in a jacket tube with a housing. Through the use of a plastic deformation of the jacket tube, where the segments have a corresponding contour, a one-piece housing for the ceramic body can be produced without destroying the body, since the body is subjected to compressive stress. As compared with a housing having half-shells, a fastening of the honeycomb body that is uniform on all sides can be attained, so that breakage of the ceramic walls is averted even under strong fastening forces. As a result, the complicated and expensive production of a honeycomb body with a jacket tube is made much simpler. The segments may be constructed with corresponding protuberances or recesses in order to clamp the jacket tube to the catalyst carrier body. If recesses are provided on the segments, then they result in beads on the outside and therefore greater rigidity of the jacket tube, which is especially advantageous since no forces, or only very slight forces, that are due to torsion (twisting) of the jacket tube act upon the body. The jacket tube can also be upended in the apparatus, in order to produce special shapes.

With the apparatus of the invention it is now even possible to place ceramic bodies in a one-piece jacket tube, without destroying the ceramic honeycomb body as a result of the plastic deformation of the jacket tube.

With the objects of the invention in view there is also provided a method for deforming a jacket tube on a honeycomb body, which comprises passing a honeycomb body with a jacket tube through at least one tunnel-like calibrating station in which the jacket tube is deformed, while maintaining a transport direction of the honeycomb body and the jacket tube during a production process.

This mode of the method presents the capability of considerably reducing the cycling time. It is now no longer necessary, as it was in the prior art, to first bring the honeycomb body to a calibrating station and after calibration has been performed to move it backward out of the calibrating station again. Due to the continuous machining of the honeycomb body, the necessary equipment expense for producing the honeycomb body drops as well, because manipulating devices that bring a honeycomb body to a calibrating station and move it back out of it again are no longer necessary.

In accordance with another mode of the invention, the honeycomb body passes successively through a plurality of calibrating stations.

In accordance with a further mode of the invention, only a predetermined axial portion of the jacket tube is deformed in each of the individual calibrating stations. The passage of the honeycomb body through individual calibrating stations in which only predetermined axial portions of the jacket tube are deformed has the advantage of permitting the tools with which the deformation is carried out to be constructed more simply. The deformation of the jacket tube can be relatively major.

In accordance with an added mode of the invention, in order to minimize wear of the tools and provide for gentle machining of the jacket tube, the jacket tube is deformed successively in the successive calibrating stations. The degree of deformation, or in other words the difference between the shape of the jacket tube before and after the deformation, as compared to the initial shape of the jacket tube, is the same in each of the individual calibrating stations.

In accordance with an additional mode of the invention, in the production of the honeycomb body, the jacket tube is deformed to variously pronounced extents in the various calibrating stations. A variously pronounced deformation of the jacket tube in the various calibrating stations results in more favorable strain on the jacket tube, since the jacket tube material can recover between calibrating stations.

In accordance with yet another mode of the invention, the honeycomb bodies with the jacket tubes pass through the individual calibrating stations in direct succession.

In accordance with yet a further mode of the invention, the honeycomb body with the jacket tube, after at least one calibrating station, is subjected to at least one further production step. The term production step is understood to mean not only steps by which the progress of production is continued but also those steps that promote the production process per se. For instance, it may be expedient to provide the jacket tube with a lubricant on the outside between two calibrating stations, in order to reduce friction between a closing segment and the jacket tube.

The honeycomb body with the jacket tube is preferably deformed in a calibrating station in which the honeycomb body with the jacket tube is disposed in a chamber defined by the segments. After that, at least one annular closing element, which has at least one oblique surface, is axially displaced. The surface slides on a sliding surface having a wedge-shaped cross section formed on each segment, and the segments are displaced radially relative to the jacket. The jacket is deformed by the radial displacement of the segments.

After the deformation of the jacket, the closing element is displaced axially in the opposite direction, causing the segments to release the jacket tube. Next, the honeycomb body with the jacket tube can be transported elsewhere. The deformation of the jacket tube by the closing process need not necessarily be carried out in a single closing process. It is proposed that the segments be closed and opened multiple times, thus successively lending the jacket tube its intended shape.

In accordance with a concomitant mode of the invention, if the honeycomb body is to be rotationally symmetrically constructed, then it is proposed that the honeycomb body be rotated about its longitudinal axis in such a way that the angle of rotation is smaller than the arc angle of one segment. The segments exert a force multiple times upon the jacket tube. The result is an even more-uniform plastic deformation. If the honeycomb body passes through a plurality of calibrating stations, then it is advantageous if the honeycomb body, before entering at least one calibrating station following a calibrating station, is rotated about its longitudinal axis, with the angle of rotation being smaller than the arc angle of a segment.

The jacket tube of a honeycomb body produced with the apparatus of the invention maintains its properties in terms of strength, since the course of the fiber in the material is not destroyed.

Other features which are considered as characteristic for the invention are set forth in the appended claims.

Although the invention is illustrated and described herein as embodied in an apparatus and a method for deforming a jacket tube of a honeycomb body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
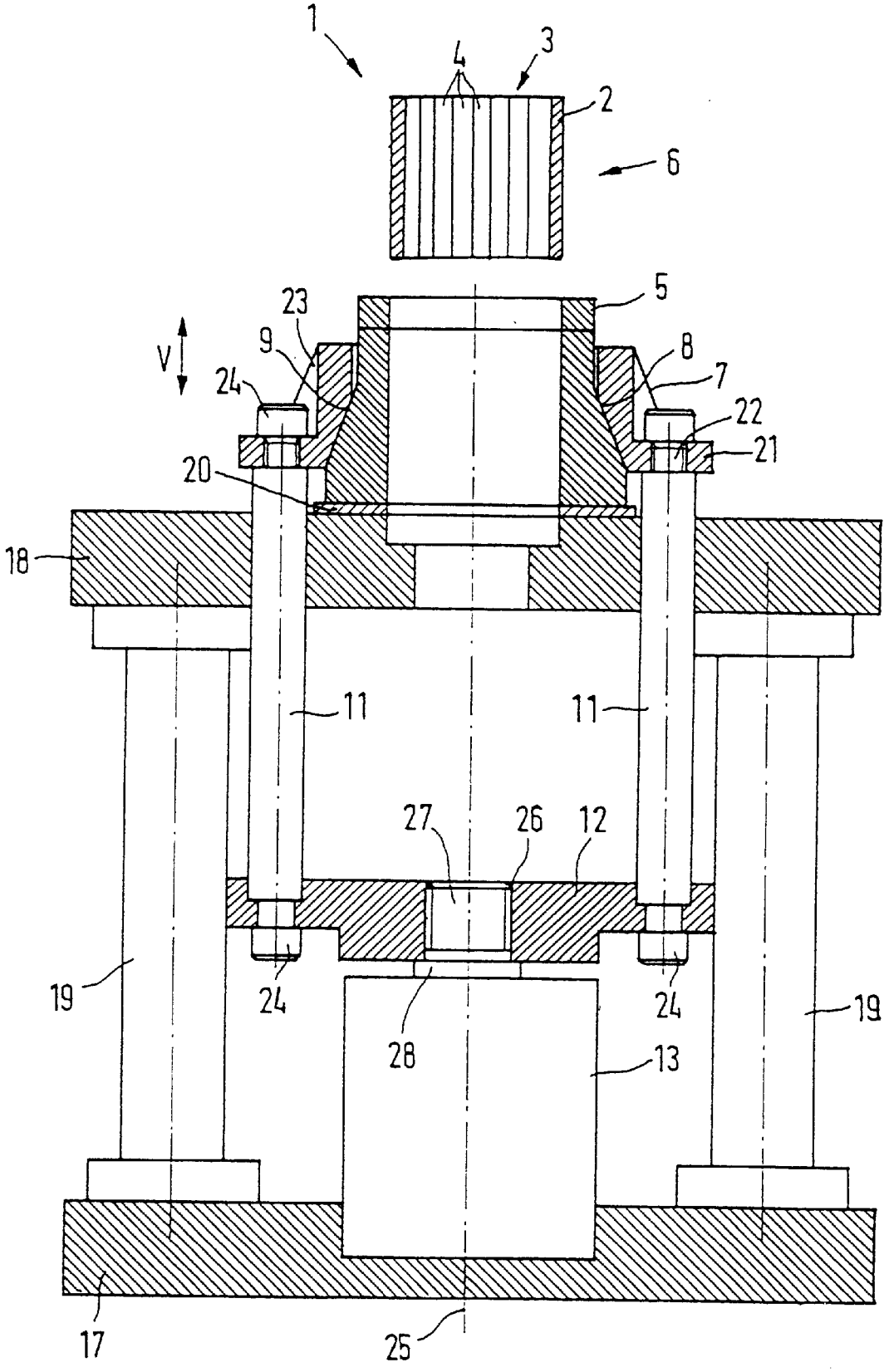
FIG. 1 is a diagrammatic, cross-sectional view of a first exemplary embodiment of an apparatus according to the invention.

Referring now to the figures of the drawings in detail and first, particularly, to FIG. 1 thereof, there is seen an apparatus which includes a bottom plate 17 and a base plate 18. The bottom and base plates 17 and 18 are spaced apart from one another. Carriers 19 are disposed between the bottom plate 17 and the base plate 18. One end of each carrier 19 is connected to the bottom plate 17 and another end of each carrier 19 is connected the base plate 18, as applicable. A plurality of segments 5 are disposed on the base plate 18. The segments 5 are substantially radially displaceable. A sliding plate 20 on which the segments 5 slide is disposed between the segments 5 and the base plate 18. The sliding plate 20 may be joined to the base plate 18, for instance by a releaseable connection, and in particular a screw connection. The segments 5 may be guided in the sliding plate 20 and/or the base plate 18. To that end, the segments 5 may have suitable protrusions that engage guide grooves. In any case, a relatively large sliding surface between the base plate 18 and the segments 5 prevents the segments from tilting.

Each segment 5 has a sliding surface 9 with a wedge-shaped cross section. The segments 5 are surrounded by an annular closing element 7, which has a conically constructed surface 8. The sliding surface 9 and the surface 8 slide on one another upon an axial displacement of the ring, as is indicated by arrows V.

Upon a downward motion of the annular closing element 7, that is toward the base plate 18, the segments 5 are displaced radially inward. As a result of this motion, they exert a force upon a jacket tube 2 of a honeycomb body 1 for exhaust gas cleaning, and they deform it plastically. The honeycomb body 1 has an outer contour 6 and a catalyst carrier body 3 with channels 4 for exhaust gas.

The annular closing element 7 has an encompassing collar 21, which is provided with through bores 22. Reinforcement ribs 23 are distributed over the circumference of the annular closing element 7 in order to attain high strength of the annular closing element.

Screws 24 extend through the through bores 22 in such a way that each screw is connected to one end of a rod 11 that extends through the base plate 18 essentially parallel to a longitudinal axis 25. An opposite end of each rod 11 is joined to a plate 12. The joining can be done by other screw fastenings 24, as shown. The plate 12 may be guided on the carriers 19. The plate 12 has a centrally constructed threaded bore 26, into which a threaded tang 27 is screwed. The threaded tang 27 forms one end of a piston rod 28 of a cylinder-piston unit 13. The cylinder-piston unit 13 is permanently disposed on the bottom plate 17.

Figure 3:
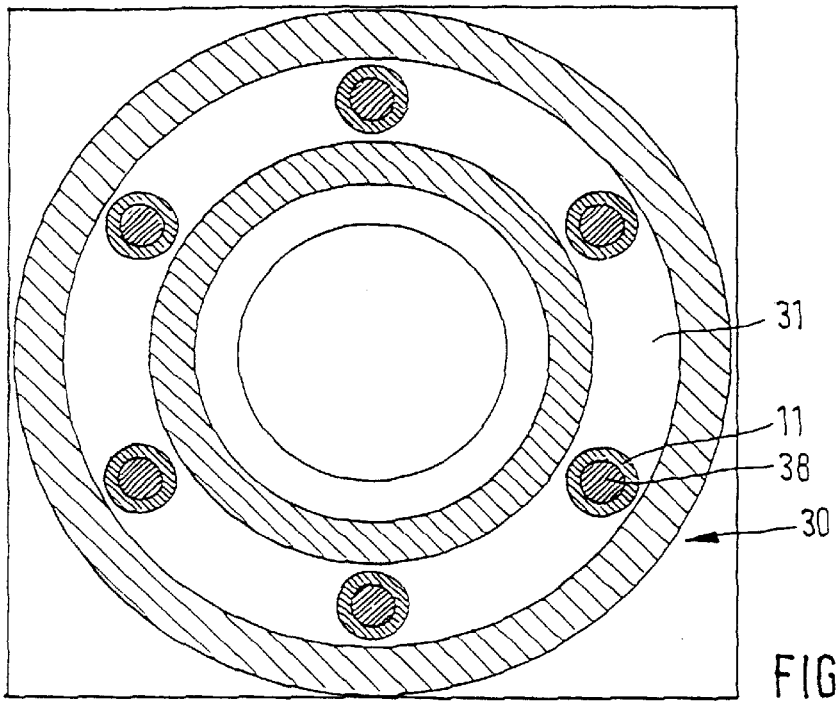
FIG. 3 is a sectional view taken along a line III—III of FIG. 2, as seen from below in the direction of the arrows.
Figure 2:
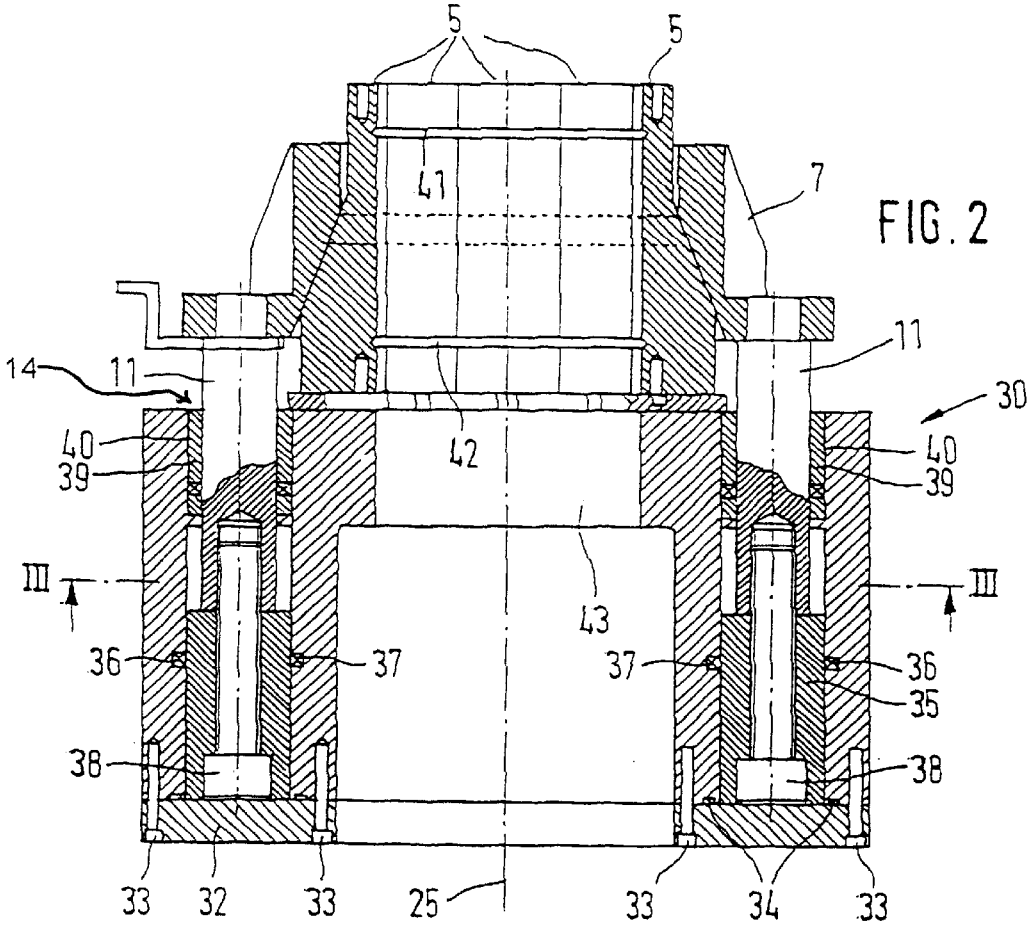
FIG. 2 is a cross-sectional view of a second exemplary embodiment of the apparatus.

FIGS. 2 and 3 show a second exemplary embodiment of an apparatus for producing a honeycomb body. Identical parts of the apparatus have the same reference numerals as in FIG. 1.

The apparatus has a frame 30. An annular chamber 31 is formed in the frame 30 and forms a cylinder of a cylinder-piston unit 14.

The chamber 31 is closed off through the use of a closure plate 32. The closure plate 32 is screwed to the frame 30 through the use of screws 33. Respective sealing O-rings 34 are disposed between the frame 30 and the closure plate 32. A piston 35 with an annular cross section is disposed in the chamber 31. Radial shaft sealing rings 36, 37 are each disposed between the piston 35 and a wall of the chamber 31.

Rods 11 which are connected to the piston 35 have one end that engages the ring 7. Another end of each rod 11 is joined to the piston 35 through the use of a screw 38. Each rod 11 is slidingly guided in a slide bushing 39. Each slide bushing is disposed in a corresponding recess 40 in the frame 30.

As can be seen from FIG. 2, the apparatus has eight segments 5. The segments 5 have recesses which are all located in the same plane and in which respective spring rings 41 and 42 are disposed.

A through opening 43 is formed below the segments 5. The through opening 43 has a cross section which substantially matches the cross section of an inner contour formed by the segments. Once a honeycomb body has been deformed plastically by the segments and the segments release the honeycomb body again, the honeycomb body can leave the apparatus through the opening 43.

Figure 4:
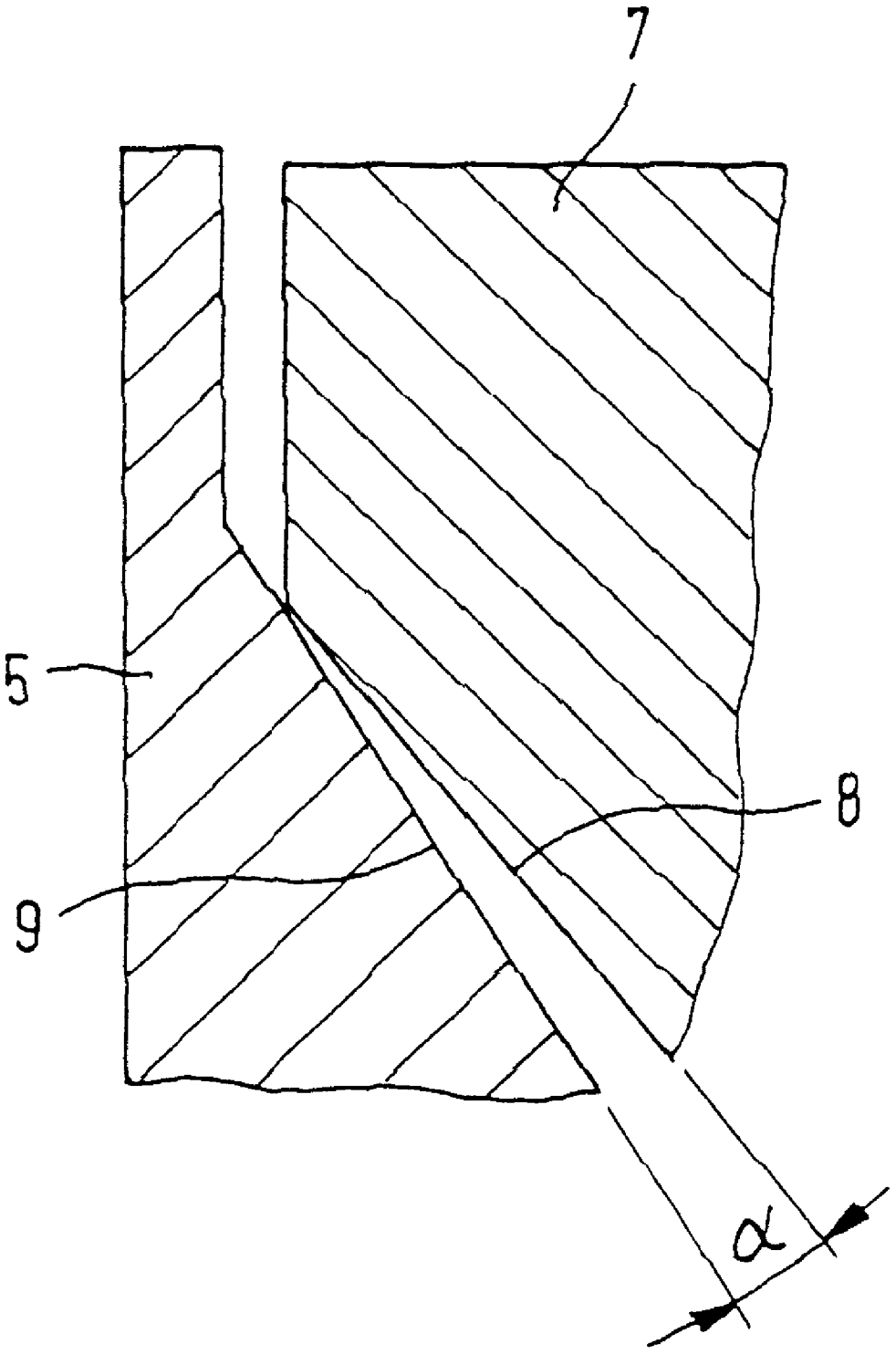
FIG. 4 is an enlarged, fragmentary, sectional view of a segment in a closing element.

The closing element 7 has a conical surface 8. The conical surface 8 glides on a sliding surface 9 of the segment 5, as is shown in FIG. 4. The two surfaces 8 and 9 have different angles of inclination with respect to a longitudinal axis 25.

Angles of inclination are chosen in such a way that an open angle $\alpha$ which is created between the two surfaces 8 and 9 is in a range between 0.5 and 3°. A pressure surface within which the force is introduced to the segments 5 from the closing element is shown in dashed lines in FIG. 2.

Figure 5:
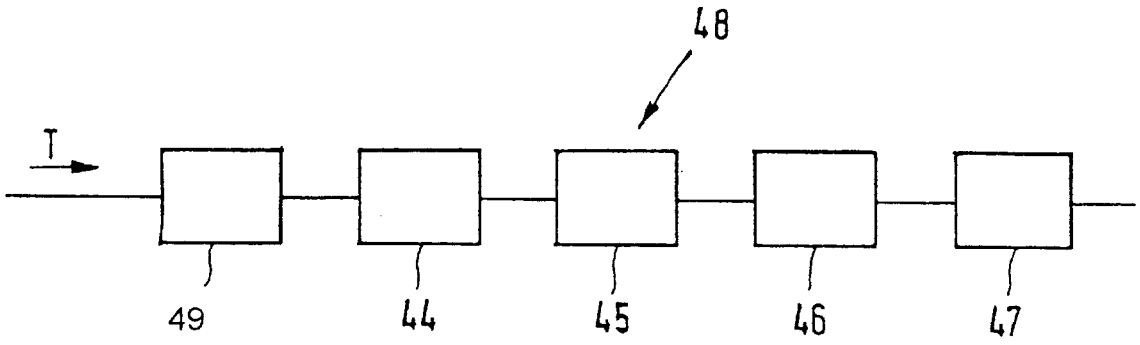
FIG. 5 is a block diagram of a transfer line.

FIG. 5 schematically shows a transfer line 48. The transfer line 48 includes calibrating stations 49, 44, 46 and 47. A machining station 45 is disposed between the calibrating stations 44 and 46. Reference symbol T indicates the direction of transport of the honeycomb bodies 1. The honeycomb bodies pass in succession through the individual stations, that is the calibrating stations and the machining stations. A calibrating station includes at least one apparatus of the kind which is shown, for instance, in FIG. 2. The individual honeycomb bodies pass successively through the calibrating stations 49, 44, 46 and 47. Each honeycomb body passing through the individual calibrating stations is deformed while keeping its direction of transport T unchanged. In the machining station 45, the honeycomb body can be subjected to a further machining operation, wherein the term "machining" is understood in its broadest sense. It can even encompass quality control of the honeycomb body. In the individual calibrating stations 49, 44, 46 and 47, a radial reduction of the jacket tube 2 can be quantitatively identical or different.

Figure 6:
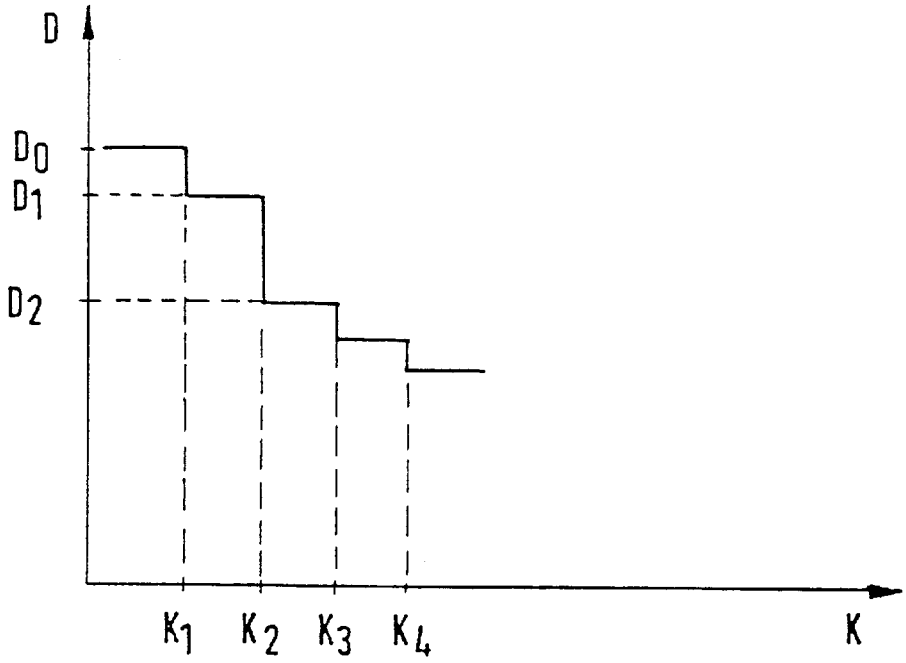
FIG. 6 is a diagram showing the diameter of a rotationally symmetrical honeycomb body after individual calibrating stations.

FIG. 6 graphically shows a diagram that indicates the diameter of a rotationally symmetrical honeycomb body after individual calibrating stations $K_1$ through $K_4$. As can be seen from the diagram, in the calibrating station $K_2$ a substantially greater reduction of the diameter of the jacket tube from $D_1$ to $D_2$ takes place in comparison with that which takes place in the other calibrating stations $K_1$, $K_3$ or $K_4$. The graph in FIG. 6 is diagrammatic. The amount of a reduction of the jacket tube that should take place within the individual calibrating stations also depends on which honeycomb body is involved and for what purpose it is to be used.

We claim:

1. An apparatus for deforming a jacket tube of a honeycomb body, comprising:

a plurality of radially displaceable segments each having a wedge-shaped sliding surface for exerting an inward force upon the jacket tube;

at least one annular, axially displaceable closing element surrounding said segments for radially displacing said segments, said closing element having at least one oblique surface sliding on said wedge-shaped sliding surfaces; and an actuating device connected to said closing element, said actuating device having an annular shape defining an opening with two sides through which a honeycomb body with a jacket tube can enter from one side and from which the honeycomb body with the jacket tube can exit from the other side.

2. The apparatus according to claim 1, wherein said plurality of segments are at least four segments.

3. The apparatus according to claim 2, wherein said plurality of segments are twelve segments.

4. The apparatus according to claim 3, wherein said segments are releaseably connectable to a number of tool segments equal to the number of said segments.

5. The apparatus according to claim 1, wherein said plurality of segments are six segments.

6. The apparatus according to claim 1, wherein said plurality of segments are eight segments.

7. The apparatus according to claim 1, wherein said segments directly deform the jacket tube.

8. The apparatus according to claim 1, wherein said segments are releaseably connectable to tool segments.

9. The apparatus according to claim 1, wherein said oblique surface is partially in contact with said sliding surface, and said surfaces form an angle with one another.

10. The apparatus according to claim 9, wherein said angle is 0.5 to 3°.

11. The apparatus according to claim 1, wherein said segments are displaceable radially inward counter to a spring force.

12. The apparatus according to claim 11, including at least one spring element joined to each of said segments for supplying the spring force.

13. The apparatus according to claim 12, wherein said at least one spring element is a spring ring.

14. The apparatus according to claim 1, wherein said actuating device includes rods engaging said closing element, a frame having an annular chamber formed therein, and a piston disposed in said chamber and joined to said rods.

15. The apparatus according to claim 1, including a stop defining an axial position of the honeycomb body between said segments.

16. The apparatus according to claim 15, wherein said stop includes lugs on at least two of said segments.

17. The apparatus according to claim 1, wherein said actuating device and said opening are disposed below said segments, said segments form a contour in a radial plane, and said opening has a cross section substantially equivalent to said contour.

18. A method for deforming a jacket tube on a honeycomb body, which comprises:

successively passing a honeycomb body with a jacket tube therearound through a plurality of calibrating stations to deform the jacket tube on the honeycomb body, while maintaining a single transport direction of the honeycomb body and the jacket tube through each calibrating station;

providing each of the calibrating stations with a plurality of radially displaceable segments each having a wedge-shaped sliding surface with an arc angle, at least one annular, axially displaceable closing element surrounding the segments and having at least one oblique surface sliding on the sliding surfaces of the segments, and an actuating device connected to the closing element for performing closing operations of the segments, the actuating device having an annular shape defining an opening with two sides;

maintaining said single transport direction through each calibration station by passing the honeycomb body with the jacket tube therearound into the opening from one side and out of the opening from the other side; and rotating the honeycomb body with the jacket tube about its longitudinal axis through an angle of rotation smaller than the arc angle of a segment, prior to entering at least one of the calibrating stations following another of the calibrating stations and between two of the closing operations of the segments, for producing a rotationally symmetrical honeycomb body.

19. The method according to claim 18, which comprises individually deforming only predetermined axial portions of the jacket tube in the calibrating stations.

20. The method according to claim 19, which comprises deforming the jacket tube to a different degree in the individual calibrating stations.

21. The method according to claim 18, which comprises successively deforming the jacket tube in the successive calibrating stations.

22. The method according to claim 21, which comprises deforming the jacket tube to a different degree in the individual calibrating stations.

23. The method according to claim 18, which comprises passing the honeycomb body with the jacket tube through the individual calibrating stations in direct succession.

24. The method according to claim 18, which comprises subjecting the honeycomb body with the jacket tube to at least one further production step at least after one of the calibrating stations.

25. The method according to claim 18, which comprises:

providing each of the calibrating stations with a plurality of radially displaceable segments each having a wedge-shaped sliding surface with an arc angle, at least one annular, axially displaceable closing element surrounding the segments and having at least one oblique surface sliding on the sliding surfaces, and an actuating device connected to the closing element and having an annular shape defining an opening with two sides;

passing a honeycomb body with a jacket tube into the opening from one side and out of the opening from the other side; and rotating the honeycomb body with the jacket tube about its longitudinal axis through an angle of rotation smaller than the arc angle of a segment, prior to entering at least one of the calibrating stations following another of the calibrating stations, for producing a rotationally symmetrical honeycomb body.

26. The method according to claim 18, which comprises:

providing each of the calibrating stations with a plurality of radially displaceable segments each having a wedge-shaped sliding surface with an arc angle, at least one annular, axially displaceable closing element surrounding the segments and having at least one oblique surface sliding on the sliding surfaces, and an actuating device connected to the closing element for performing closing operations of the segments, the actuating device having an annular shape defining an opening with two sides;

passing a honeycomb body with a jacket tube into the opening from one side and out of the opening from the other side; and rotating the honeycomb body with the jacket tube about its longitudinal axis through an angle of rotation smaller than the arc angle of a segment, between two of the closing operations of the segments, for producing a rotationally symmetrical honeycomb body.

* * * * *